US005636796A

United States Patent [19]

Oguma

[11] Patent Number: 5,636,796

[45] Date of Patent: Jun. 10, 1997

[54] FLUID INJECTION NOZZLE

[75] Inventor: Yoshitomo Oguma, Kariya, Japan

[73] Assignee: Nippondenso Co., Ltd., Kariya, Japan

[21] Appl. No.: 398,129

[22] Filed: Mar. 3, 1995

[30] Foreign Application Priority Data

Mar. 3, 1994 [JP] Japan ..... 6-033758

[51] Int. Cl.[6] ..... F02M 61/00

[52] U.S. Cl. ..... 239/533.12; 239/585.3; 239/596

[58] Field of Search ..... 239/533.12, 584, 239/585.3, 590.3, 596, 601

[56] References Cited

U.S. PATENT DOCUMENTS

| | | | |
|---|---|---|---|
| 4,907,748 | 3/1990 | Gardner et al. | 239/590.3 |
| 4,925,111 | 5/1990 | Foertsch et al. | 239/533.12 |
| 4,934,605 | 6/1990 | Hans et al. | 239/596 |
| 5,193,747 | 3/1993 | Preussner | 239/533.12 |
| 5,244,154 | 9/1993 | Buchholz et al. | 239/590.3 |
| 5,273,215 | 12/1993 | Hans et al. | 239/533.12 |
| 5,323,966 | 6/1994 | Buchholz et al. | 239/533.12 |
| 5,492,277 | 2/1996 | Tani et al. | 239/596 |

FOREIGN PATENT DOCUMENTS 503757 9/1992 European Pat. Off. .

*Primary Examiner*—Andres Kashnikow
*Assistant Examiner*—Lisa Ann Douglas
*Attorney, Agent, or Firm*—Cushman, Darby & Cushman IP Group of Pillsbury Madison & Sutro LLP

[57] ABSTRACT

A fluid injection nozzle which can atomize a fluid and spray it in a plurality of directions and can be easily manufactured. A first orifice plate is made of metal and has a slit-shaped first orifice provided in a central portion thereof. A second orifice plate is also made of metal and is provided with two second orifices which become narrower with progress in the downstream direction of the fuel flow. The upstream and downstream side openings of the second orifice and the upstream and downstream side openings of the second orifice are eccentric. As a result, fuel passing through the second orifices is guided in the directions of the eccentricity and a fluid injection nozzle having ideal injection directions can be obtained.

16 Claims, 8 Drawing Sheets

FLUID INJECTION NOZZLE

CROSS REFERENCE TO RELATED APPLICATION

This application is based upon and claims priority from Japanese Patent Application No.6-33758 filed Mar. 3, 1994 the contents of which are incorporated herein by reference.

BACKGROUND OF THE INVENTION

1. Field of the Invention

This invention relates to a fluid injection nozzle. For example, this invention relates to the injection nozzle of an electromagnetic fuel injection valve for supplying fuel to an internal combustion engine for automotive use by means of injection.

2. Description of the Related Art

A conventional fluid injection nozzle is the one provided with a plurality of plates overlaid on one another and formed of silicone having orifices on the front of the injection hole thereof, wherein for example, the plates having a plurality of slit-shaped orifices are overlappingly arranged on their downstream side surfaces so that at least parts of the respective orifices communicate with one another and by supplying fuel to these orifices through the injection hole, fuel atomized and spread in a wide angle is injected to a plurality of directions.

The fluid injection nozzle mentioned above is illustrated in the FIGS. 12 and 13. The sheet part 100*a* of a needle 100 is formed so as to be brought into contact with the valve seat 101*a* of a needle body 101. First and second orifice plates 110 and 112 are provided on the fuel downstream side of the injection hole 101*b* of the needle body 101. The second orifice plate 112 is overlaid on the under surface of the first orifice plate 110. A sleeve 102 is fittingly inserted with pressure into the needle body 101 and thereby the first orifice plate 110 is fixed on the end face 101*c* of the needle body 101.

The first orifice plate 110 comprises a first tapered orifice 111 toward a slit-shaped fuel downstream side while the second orifice plate 112 comprises two second tapered orifices 113 and 114 toward the fuel downstream side. Here, the term "tapered" means that a cross-sectional area is gradually reduced from the fuel upstream side to the fuel downstream side. The second orifice 113 comprises square-like apertures 113*a* and 113*b* on the fuel upstream and downstream sides and the apertures 113*a* and 113*b* are concentrically formed. Also, the second orifice 114 comprises square-like apertures 114*a* and 114*b* on the fuel upstream and downstream sides and the apertures 114*a* and 114*b* are concentrically formed.

At the fluid injection nozzle shown in the FIGS. 12 and 13, the second orifices 113 and 114 are arranged on the downstream side of the first orifice 111 and thereby, dual-oriented spaying is obtained. Further, the direction of dual-oriented spraying can be adjusted by changing a space between the second orifices 113 and 114.

At the fluid injection nozzle shown in the FIGS. 12 and 13, however, the predetermined direction of spaying cannot be obtained when shifts in the positions of the first orifice 111 and the second orifices 113 and 114 is occurred. Further, in the case where an orifice is made of silicone, the direction of spaying cannot be adjusted by changing the tilt angle of the orifice, since etching is possible only at the same tilt angle.

SUMMARY OF THE INVENTION

It is an object of the present invention to solve the above-mentioned problems by providing an easily manufactured fluid injection nozzle capable of atomizing a fluid and spaying in a plurality of directions.

In order to achieve the above-mentioned object, the fluid injection nozzle includes a first plate having a first slit hole through which a fluid passes and a second plate overlaid on the downstream side of the first plate and provided with a plurality of second holes to be communicated with a part of the first hole, wherein the upstream and downstream side apertures of the second holes are made eccentric.

In one preferred mode, the upstream and downstream side apertures are formed into a polygonal shape and the second holes are formed of a plurality of planar inner walls extending from the upstream side aperture to the downstream side aperture.

The fluid injection nozzle, in other preferred mode of this invention, includes a first plate having a first slit hole through which a fluid passes and a second plate overlaid on the downstream side of the first plate and provided with a plurality of second polygonal holes which communicate with a part of the first hole and whose cross-sectional areas are gradually reduced toward the downstream side, wherein a pair of adjacent ones of a plurality of inner walls defining the second holes spread in a predetermined direction of fluid injection.

The fluid injection nozzle, in other preferred mode of this invention, includes a first plate having a first slit hole through which a fluid passes and a second plate overlaid on the downstream side of the first plate and provided with a plurality of second polygonal holes which communicate with a part of the first hole and whose cross-sectional areas are gradually reduced toward the downstream side, wherein a pair of adjacent ones of a plurality of sides constituting a polygon which specifies the upstream and downstream side apertures of the second holes spread in the predetermined direction of fluid injection.

At the fluid injection nozzle, eccentricity between the upstream and downstream side apertures of the second holes arranged on the downstream side of the first hole allows flowing of a fluid from the upstream side aperture to the eccentric direction of the downstream side aperture even when a positional shift between the first and second holes occurs and thus, by changing this eccentric direction desired sprayings can be carried out into different directions from a plurality of second holes. Desired sprayings, in this case, include particle conditions, distribution, angles, forms, penetration, etc.

At the fluid injection nozzle, in one preferred mode of this invention, since the upstream and downstream side apertures are made eccentric and the second holes are formed of a plurality of planar inner walls, flowing of a fluid from the upstream side aperture to the eccentric direction of the downstream side aperture is satisfactorily directed. Therefore, it is made easier to control the direction of fluid spaying.

Further, at the fluid injection nozzle, in other preferred mode of this invention, since a pair of adjacent ones of a plurality of inner walls forming the second holes extend in the desired direction of fluid injection, by changing an opening angle between this pair of adjacent inner walls desired control of sprayings from a plurality of second holes into different directions can be carried out.

Further, at the fluid injection nozzle, in other preferred mode of this invention, since a pair of adjacent ones of sides corresponsive between the upstream and downstream side apertures of the second holes extend in the desired direction of fluid injection, by changing an opening angle between this pair of adjacent sides desired control of sprayings from a plurality of second holes into different directions can be carried out.

Further, at the fluid injection nozzle, in other preferred mode of this invention, at least one of the first and second plates is made of metal. Thus, when the second plate is made of metal, inclination of the inner walls forming the second holes can be easily changed and an optimum injection direction can be obtained.

DETAILED DESCRIPTION OF THE PRESENTLY PREFERRED EXEMPLARY EMBODIMENTS

Embodiments according to the present invention will be described below with reference to the accompanying drawings.

(First Embodiment)

FIGS. 1 to 6 show a first embodiment, wherein the fluid injection nozzle according to the present invention is applied to the fuel injection valve of a fuel supplying device for a gasoline engine.

Figure 2:
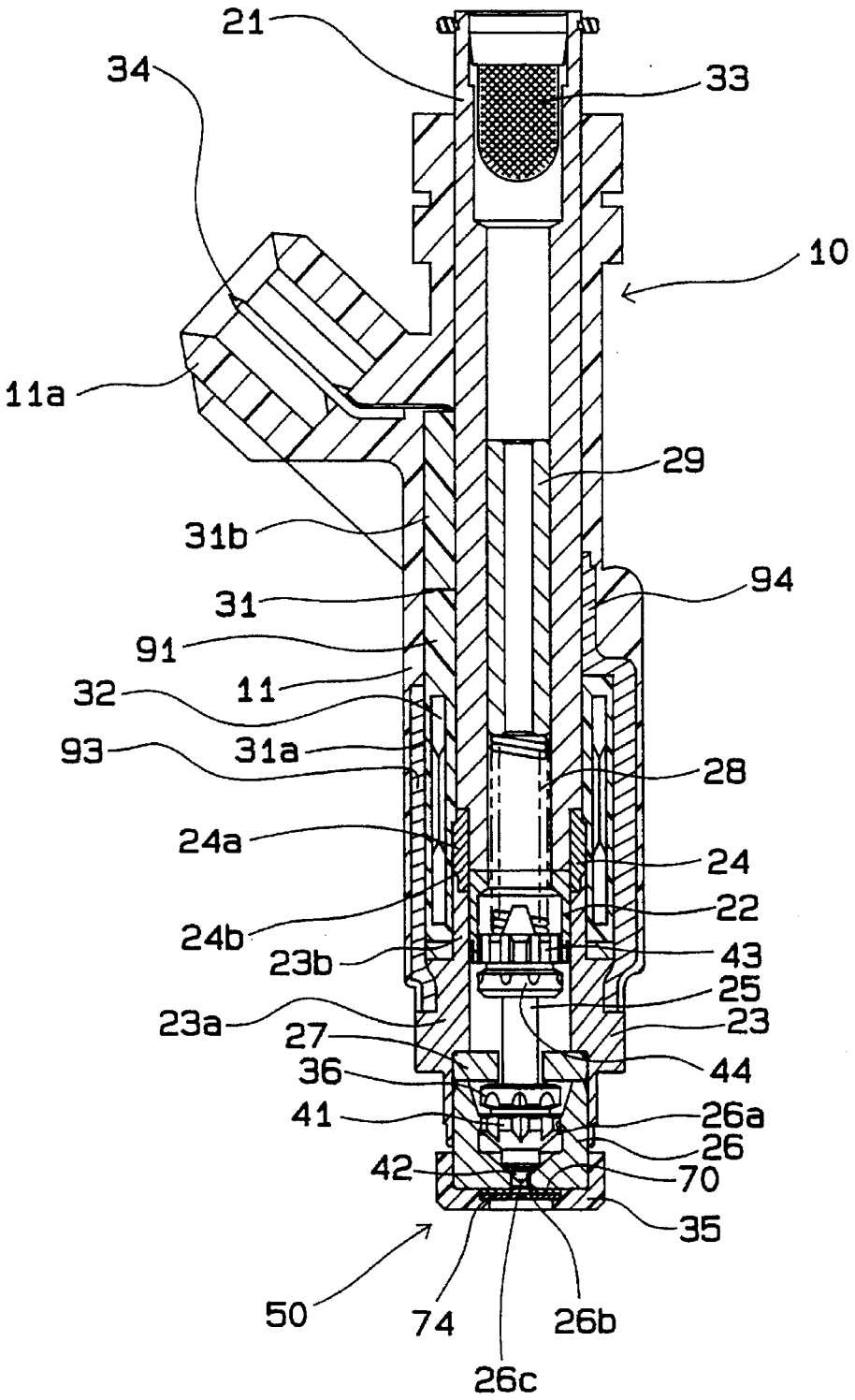
FIG. 2 shows a cross-sectional view showing the fuel injection device to which the fluid injection valve is applied according to the first embodiment of the present invention.

As shown in FIG. 2, a fixed iron core 21, a spool 91, an electromagnetic coil 32, a coil mold 31 and metallic plates 93 and 94 as magnetic circuits are integrally formed inside the resin housing 11 of a fuel injection valve 10 which works as a fluid injection nozzle.

The fixed iron core 21 is made of a strong magnetic material and installed in the housing 11 so as to be projected from the upper side of the coil mold 31. A guide pipe 29 is fixed on the inner wall of the fixed iron core 21.

The electromagnetic coil 32 is wound on the outer periphery of the spool 91 made of resin, and then the coil mold 31 is molded with resin on the outer periphery of the spool 91 and electromagnetic coil 32, so that the electromagnetic coil 32 is surrounded by the coil mold 31. The coil mold 31 is constructed by a cylindrical part 31*a* for protecting the electromagnetic coil 32 and a projecting part 31*b* which is protruded upward from the cylindrical part 31*a* for protecting a lead wire electrically drawn from the electromagnetic coil 32 and holding a terminal 34 (described later). Then, the spool 91 and the electromagnetic coil 32 are attached to the outer periphery of the fixed iron core 21 in the condition that they are made integral by the coil mold 31.

Two metallic plates 93 and 94 are provided with one ends of their upper sides coming into contact with the outer periphery of the fixed iron core 21 and the other ends of their lower sides coming into contact with the outer periphery of a magnetic pipe 23. The plates 93 and 94 act as members for forming magnetic circuits through which magnetic fluxes at the time of power supply are sent to the electromagnetic coil 32. The outer periphery of the cylindrical part 31*a* is coated by the plates, in such a manner that the part 31*a* is held from both sides thereof. The electromagnetic coil 32 is protected by the two metallic plates 93 and 94.

A connector part 11*a* is provided on the upper side of the housing 11 so as to be projected from the outer wall thereof. The terminal 34 electrically connected to the electromagnetic coil 32 is embedded in the connector part 11*a* and the coil mold 31. In addition, the terminal 34 is connected to an electric control device (not shown in the figure) with a wire harness.

One end of a compressed coil spring 28 is abutted to the upper end surface of a needle 25 which is welded on a movable iron core 22, and the other end of the compressed coil spring 28 is abutted to the bottom part of the guide pipe 29. The movable iron core 22 and the needle 25 is pressed downward by the compressed coil spring 28 (in FIG. 2) so as to place the sheet part 42 of the needle 25 on the valve seat 26*b* of a needle body 26. When an exciting current is flown from the terminal 34 to the electromagnetic coil 32 through the lead wire by the electronic control device (not shown in the figure), the needle 25 and the movable iron core 22 are attracted toward the fixed iron core 21 against the pressing force of the compressed coil spring 28.

A nonmagnetic pipe 24 is connected to the lower part of the fixed iron core 21 and formed in the shape of a stepped pipe having large and small diameter parts 24*a* and 24*b*. The large diameter part 24*a* is connected to the lower part of the fixed iron core 21, in such a manner that a part of the part 24*a* is projected from the lower end of the core 21. Further, the small diameter part 23*b* of a magnetic pipe 23 made of a magnetic material and formed in the shape of a stepped pipe is connected to the lower end of the small diameter part 24*b* of the nonmagnetic pipe 24. Furthermore, the inner diameter of the small diameter part 24*b* of the nonmagnetic pipe 24 is set slightly smaller than that of the small diameter part 23*b* of the magnetic pipe 23 constituting the guiding part of the movable iron core 22.

The movable iron core 22 made of a magnetic material and cylindrically formed is provided on the internal space of the nonmagnetic pipe 24 and the magnetic pipe 23. The outer diameter of this movable iron core 22 is made slightly smaller than the inner diameter of the small diameter part 24*b* of the nonmagnetic pipe 24, and the movable iron core 22 is slidably supported on the nonmagnetic pipe 24. Further, the upper end surface of the movable iron core 22 is placed opposed to the lower end surface of the fixed iron core 21 with a predetermined space therebetween.

A flange-shaped joint part 43 is formed on the upper part of the needle 25. The joint part 43 and the movable iron core 22 are welded by laser and the needle 25 and the movable iron core 22 are coupled integrally. Further, a flange 44 is formed in the vicinity of the lower side of the joint part On the needle 25 a flange 36 is formed so as to be placed opposed to the lower end surface of a spacer 27 which is housed in the inner wall of the large diameter part 23*a* of the magnetic pipe 23 through a predetermined gap therebetween. The flange 36 is positioned on the sheet part 42 formed on the tip end of the entire length of the needle 25. Still further, knurled grooves are formed on the joint part 43 to be formed on the needle 25 and the periphery of a guiding part 41 by means of form rolling, etc.

The needle body 26 is inserted into the large diameter part 23*a* of the magnetic pipe 23 with the hollow disk-shaped spacer 27 and welded by laser to the inner wall thereof. The thickness of the spacer 27 is adjusted so as to hold an air gap between the fixed iron core 21 and the movable iron core 22 at a predetermined value.

On the upper side of the fixed iron core 21, a filter 33 is installed in order to remove foreign matters of dust, etc., in the fuel forcibly transferred from a fuel tank by a fuel pump, etc., and flown into the fuel injection valve 10.

Fuel flown into the fixed iron core 21 through the filter 33 passes through the spaces with the knurled grooves formed on the joined part 43 of the needle 25 from the guide pipe 29, further through the spaces with the knurled grooves formed on the cylindrical surface 26*a* of the needle body 26 and the guiding part 41 of the needle 25, reaches a valve part formed together with the sheet part 26*b* on the tip of the needle 25 and from the valve part reaches an injection hole 26*c*. Then, passing through the first orifice 71 of a first orifice plate 70 and the second orifice 75 of a second orifice plate 74 communicated with the first orifice 71, the fuel is injected from the through-hole 35*b* of a sleeve 35.

A construction of the delivery part 50 of the fuel injection valve 10 is described below with reference to FIG. 1.

On the inner wall of the needle body 26, the cylindrical surface 26*a* on which the guiding part 41 of the needle 25 slides and the valve seat 26*b* on which the conical sheet part 42 of the needle 25 sits are formed. Further, the injection hole 26*c* is formed on the center of the bottom part of the needle body 26.

The bottomed cylindrical sleeve 35 made of synthetic resin is fittingly inserted into the bottom part of the outer peripheral wall of the needle body 26. A housing hole 35*a* is formed on the center of this sleeve 35 and the through-hole 35*b* is formed so as to be extended from the housing hole 35*a*.

The first orifice plate 70 is placed on the front side of the injection hole 26*c* of the needle body 26, the second orifice plate 74 is overlapping stuck to the lower surface of this first orifice plate 70, these first and second orifice plates 70 and 74 are welded by laser and fixed on the end surface 26*d* of the needle body 26 water-tightly and further, the sleeve 35 for protection is fittingly inserted with pressure, and fixed on the needle body 26.

Figure 3:
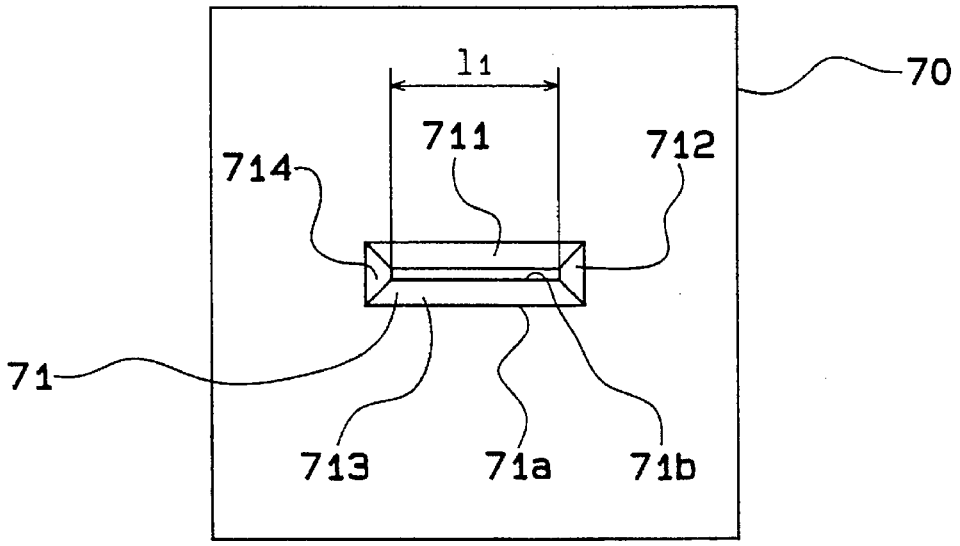
FIG. 3 shows a planar view showing the first orifice plate according to the first embodiment of the present invention.

The first orifice plate 70 is made of metal and, as shown in the FIG. 3, the first orifice 71 as a slit-shaped hole is formed on the center. Although any metal can be used for forming the first orifice plate 70 as long as it has corrosion resistance against fuel, SUS 304 is suitable because it allows easy forming and weight reduction. The first orifice 71 is defined by four opposing inner walls 711, 712, 713 and 714, is thin and linear in shape, and is made to a through-hole with its cross-sectional area gradually declining toward the lower part of FIG. 1 (downstream side of a fuel flow). Upstream and downstream side apertures 71*a* and 71*b* are rectangularly formed and the area of the upstream side aperture 71*a* is larger than that of the downstream one 71*b*. The first orifice 71 is manufactured by means of punch-pressing, electric discharge machining, etc.

Figure 4:
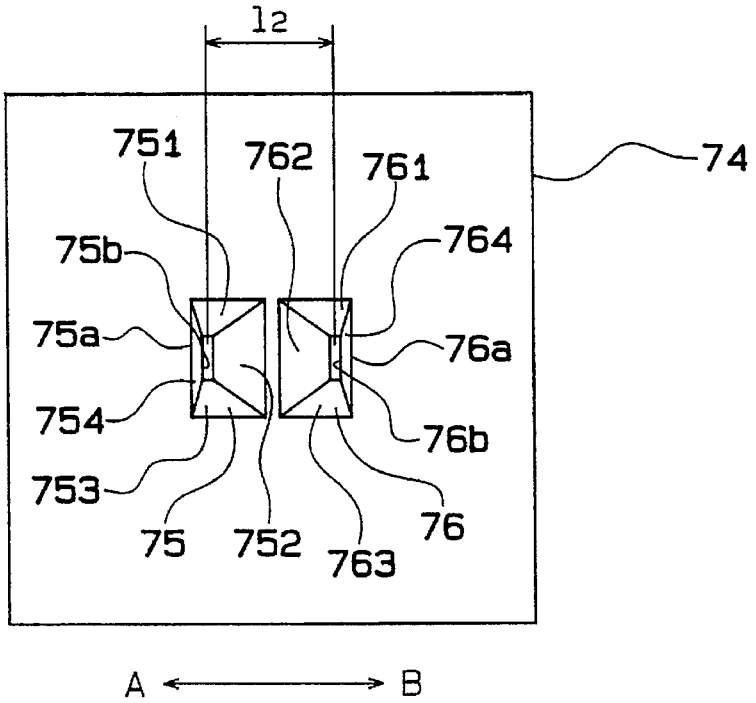
FIG. 4 shows a planar view showing the second orifice plate according to the first embodiment of the present invention.
Figure 5:
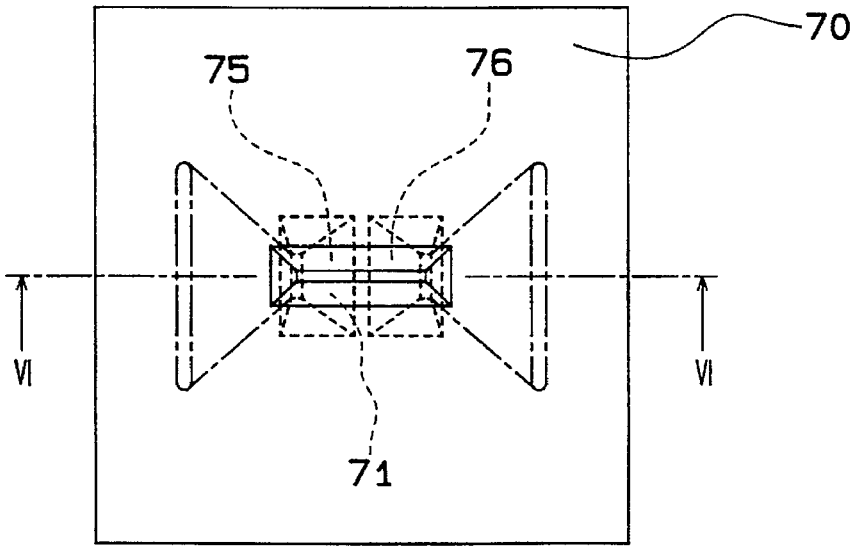
FIG. 5 shows a planar view showing the condition where the first and second orifice plates are overlapped and the spraying condition according to the first embodiment of the present invention.
Figure 6:
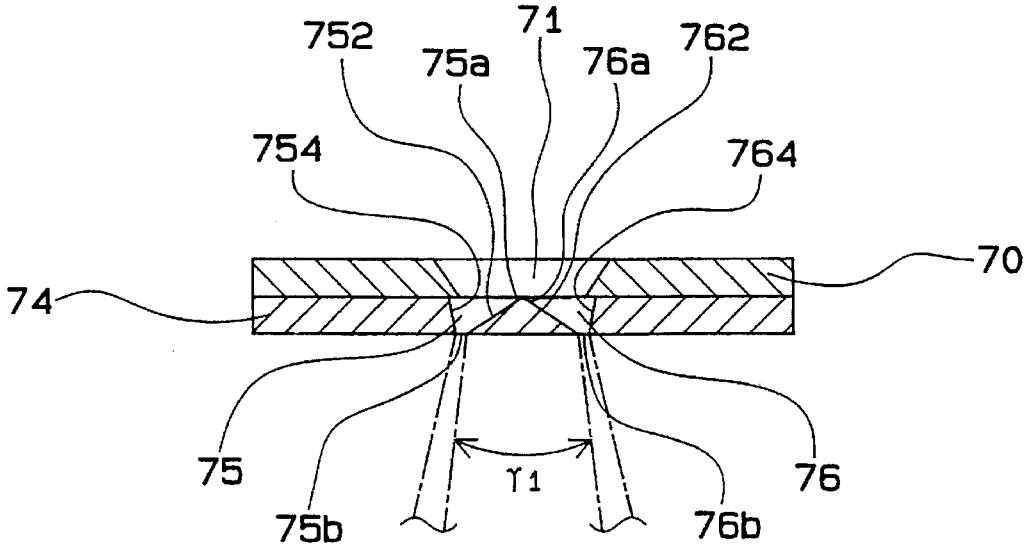
FIG. 6 shows a cross-sectional view along VI—VI line of FIG. 5.

The second orifice plate 74 is made of stainless steel, as well. As shown in FIG. 4, the orifice plate 74 is provided with the second orifices 75 and 76 as two holes. As in the case of the first orifice 71, the second orifices 75 and 76 are manufactured by means of punch-pressing, electric discharge machining, etc.

Figure 1:
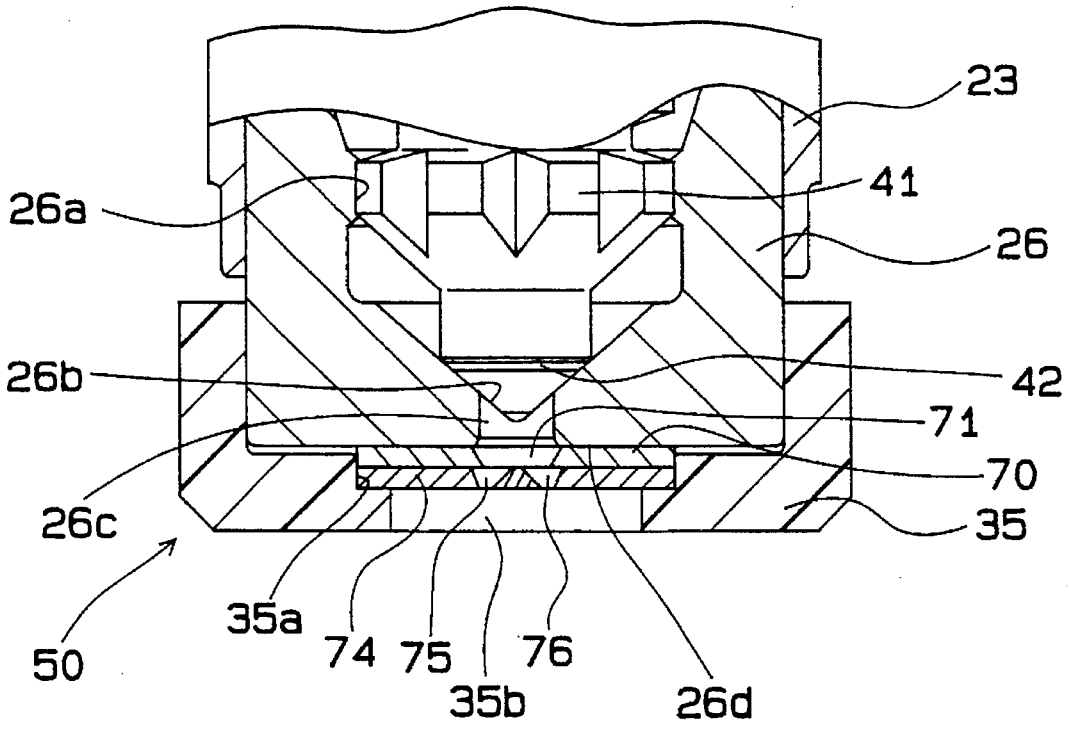
FIG. 1 shows a cross-sectional view showing the vicinity of the injection hole of the fuel injection device to which the fluid injection valve is applied according to the first embodiment of the present invention.

The second orifice 75 is formed of planar and trapezoidal inner walls 751, 752, 753 and 754 tapering off toward the lower part of FIG. 1 (downstream side of a fuel flow). Rectangular apertures 75*a* and 75*b* are formed respectively on fuel upstream and downstream ends of the inner walls 751, 752, 753 and 754. As the second orifice 75 is tapered in form, the area of the aperture 75*a* is larger than that of the aperture 75*b*. The opposing inner walls 751 and 753 tilt so as to approach from the upstream side to the downstream side at about the same angle while the opposing inner walls 752 and 754 are formed with the former inclining in the direction of an arrow A (in FIG. 4) more than the latter. Thus, the apertures 75*a* and 75*b* are made eccentric.

The second orifice 76 is also formed of trapezoidal inner walls 761, 762, 763 and 764 tapering off toward the lower part of FIG. 1 (downstream side of a fuel flow). Rectangular apertures 76*a* and 76*b* are formed respectively on fuel upstream and downstream ends of the inner walls 761, 762, 763 and 764. Because of tapered formation of the second orifice 76, the area of the aperture 76*a* is larger than that of the aperture 76*b*. The opposing inner walls 761 and 763 tilt so as to approach the upstream side to the downstream side at about the same angle while the opposing walls 762 and 764 are formed with the former inclining in the direction of an arrow B (in FIG. 4) more that the latter. Thus, the apertures 76*a* and 76*b* are made eccentric.

Here, the apertures 75*b* and 76*b* are made eccentric shifting away in opposing directions. The first orifice 71 is formed so that the length l1 of a longitudinal direction is longer than the distance l2 between the centers of the apertures 75*b* and 76*b*.

In FIG. 1, when the needle 25 lifts from the valve seat 26*b* of the needle body 26, fuel is injected through the injection hole 26*c*. Then, the fuel injected through the injection hole 26*c* is injected and supplied from the first orifice 71 to the second orifices 75 and 76. The fuel injected and supplied to the second orifices 75 and 76 flows along the inner walls 751, 752, 753 and 754 and along the ones 761, 762, 763 and 764 respectively and is injected from the through-hole 35*b* to a combustion chamber (not shown in the drawings). At this time, since the inner wall 752 inclines more than the one 754 and the inner wall 762 inclines more than the one 764, when the fuel flowing along the inner walls 752 and 762 meets the one flowing along the inner walls 754 and 764, sprayings are carried out into two differing directions at an angle γ1 as shown by the chain lines in FIGS. 5 and 6. This fuel spaying angle γ1 and the spraying directions can be adjusted by the tilt angles of the inner walls 751, 752, 753, 754, 761, 762, 763 and 764 for defining the second orifices 75 and 76.

According to the first embodiment, as the apertures 75*a* and 75*b* and the ones 76*a* and 76*b* are made eccentric respectively, the direction of fuel spraying (two directions in this case) is specified by the tilt angles of the inner walls 752 and 754 and the ones 762 and 764. Therefore, even when shifts in the overlapping positions of the first and second orifice plates 70 and 74 is occurred, the direction of fuel spraying is maintained constant. Further, as this injected fuel passes through the first tapered orifice 71 and then further passes through the second tapered orifices 75 and 76, it is atomized and formed into sprays having narrow-angled and suitable spraying characteristics in two directions. Thus, the fuel supplied from an intake port (not shown in the drawings) to the combustion chamber of the internal combustion engine is formed into easily burnt sprays.

In the first embodiment, as the second orifices 75 and 76 are formed with their cross-sectional areas gradually tapering off toward the fuel downstream side, the areas of the apertures 75*a* and 76*a* are larger than those of the ones 75*b* and 76*b*. However, the present invention allows carrying out dual-direction injection by forming them into the ones having the same size if the apertures at the upstream and downstream sides are made eccentric. Further, if the upstream and downstream side apertures are eccentric, their shapes can be chose from squares, triangles, pentagons and other polygons. Still further, by circularly forming the upstream and downstream side apertures of the second orifice surrounded by the curved inner walls and making them eccentric, the second orifice can be formed into an eccentric and conical trapezoid with its cross-sectional area gradually declining toward the downstream side and dual-direction injecting can be carried out.

In the first embodiment, the apertures 75*b* and 76*b* are formed so that they are made eccentric and shift away in opposing directions. However, the present invention allows changing of the eccentric direction of the downstream side aperture against the upstream side aperture in any way by adjusting the tilt angles of the inner walls and in accordance with this eccentric direction, the direction of injection can be changed.

Further, in the first embodiment, the first orifice 71 is formed in a tapered shape. However, the present invention allows straight and sectorial formation thereof.

(Second Embodiment)

A second embodiment is illustrated in FIGS. 7 to 11, wherein the fluid injection nozzle of the present invention is applied to the fuel injection valve of a fuel supplying device for a gasoline engine.

Figure 7:
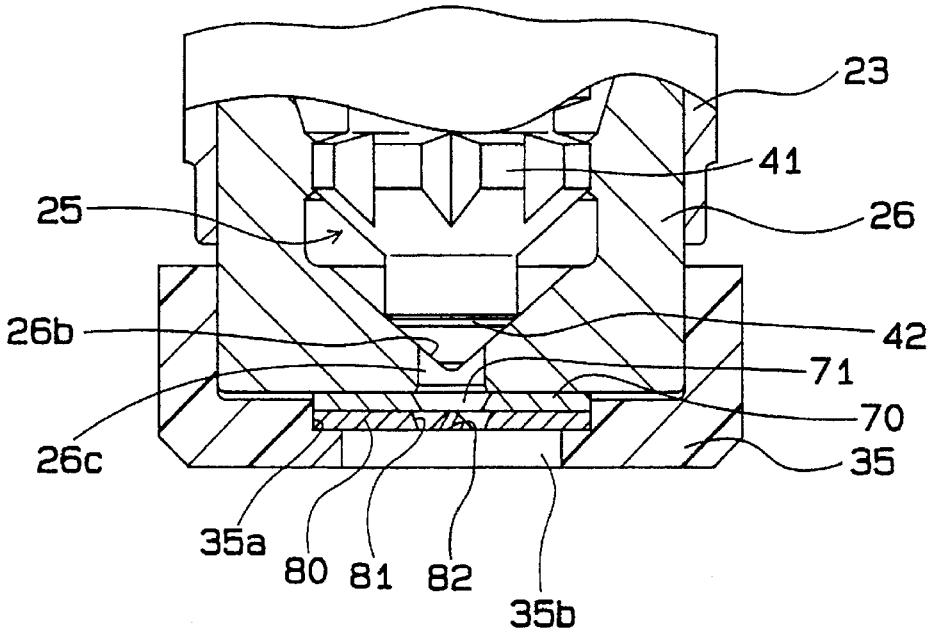
FIG. 7 shows a cross-sectional view showing the vicinity of the injection hole of the fuel injection device to which the fluid injection valve is applied according to the second embodiment of the present invention.
Figure 8:
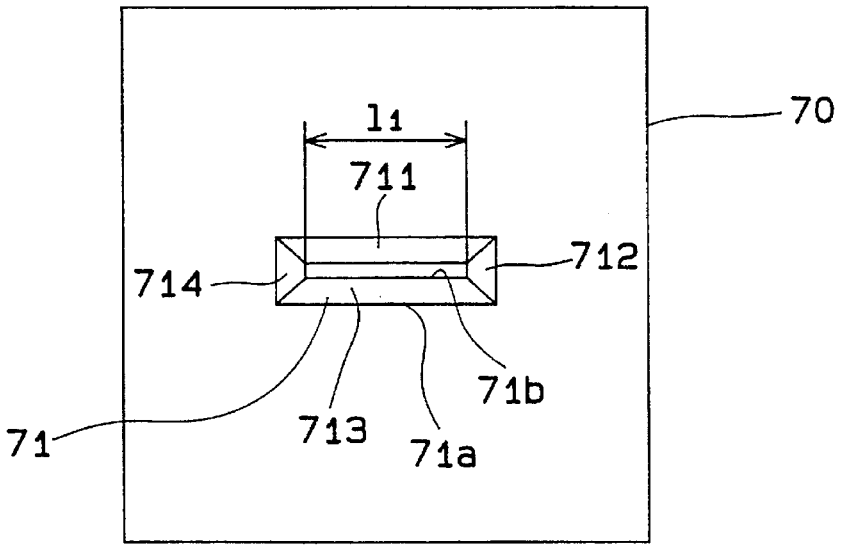
FIG. 8 shows a planar view showing the first orifice plate according to the second embodiment of the present invention.
Figure 9:
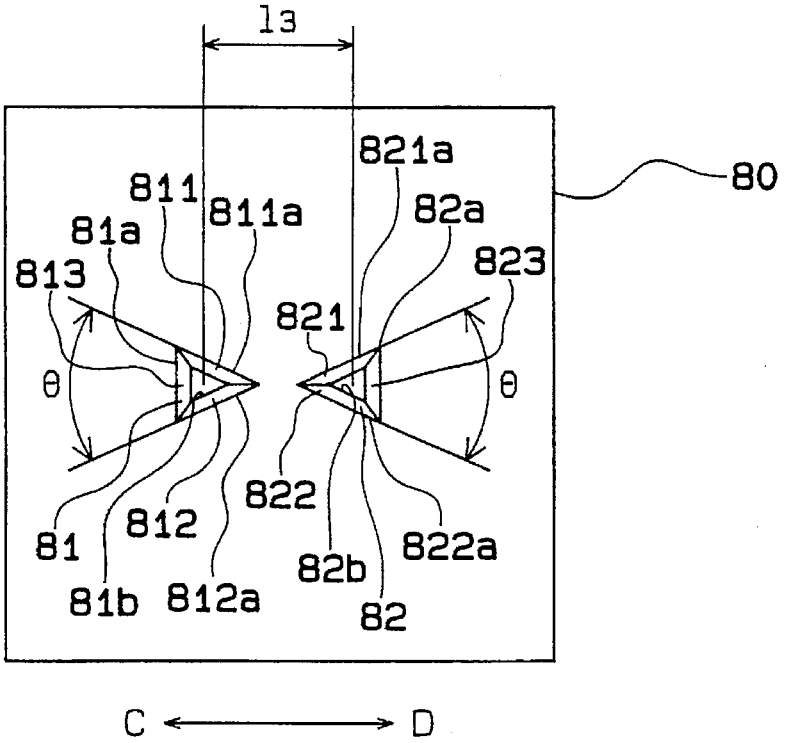
FIG. 9 shows a planar view showing the second orifice plate according to the second embodiment of the present invention.

As shown in FIG. 7, a second orifice plate 80 is overlaid on the under surface of a first orifice plate 70. The first orifice plate 70 has the same construction as the one in the first embodiment. As shown in FIG. 9, the second orifice plate 80 is provided with second orifices 81 and 82 as two holes.

The second orifice 81 is formed of trapezoidal inner walls 811, 812 and 813 tapering off toward the lower part of the FIG. 7 (downstream side of a fuel flow). The inner walls 811 and 812 open in the direction of an arrow C (in FIG. 9). On the fuel upstream and downstream ends of the inner walls 811, 812 and 813, isosceles triangular apertures 81*a* and 81*b* are formed concentrically and similarly and two sides 811*a* and 812*a* holding an apex angle in-between open in the direction of the arrow C at an angle Θ.

The second orifice 82 is also formed of trapezoidal inner walls 821, 822 and 823 tapering off toward the lower part of FIG. 7 (downstream side of a fuel flow). The inner walls 821 and 822 open in the direction of an arrow D (in FIG. 9). On the fuel upstream and downstream ends of the inner walls 821, 822 and 823, isosceles triangular apertures 82*a* and 82*b* are formed concentrically and similarly and two sides 821*a* and 822*a* holding an apex angle in-between open in the direction of the arrow D at an angle Θ.

Figure 10:
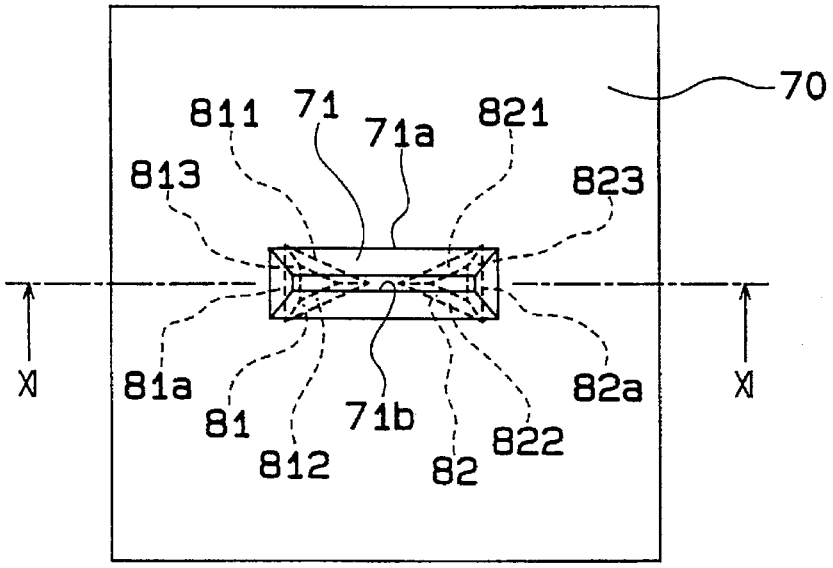
FIG. 10 shows a planar view showing the overlapping condition between the first and second orifice plates according to the second embodiment of the present invention.
Figure 11:
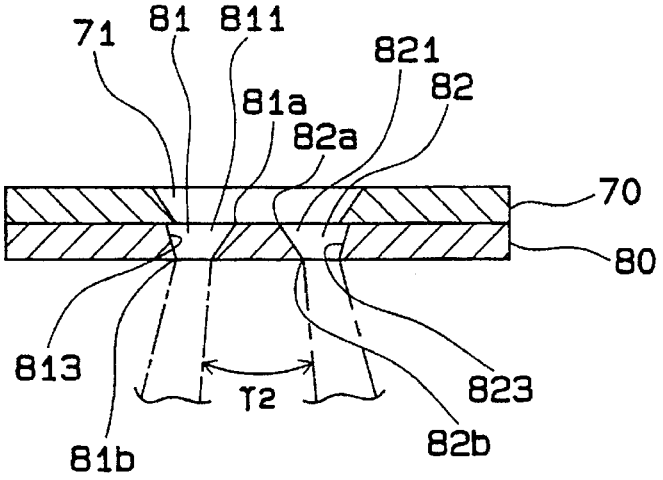
FIG. 11 shows a cross-sectional view along XI—XI line of FIG. 10.
Figure 12:
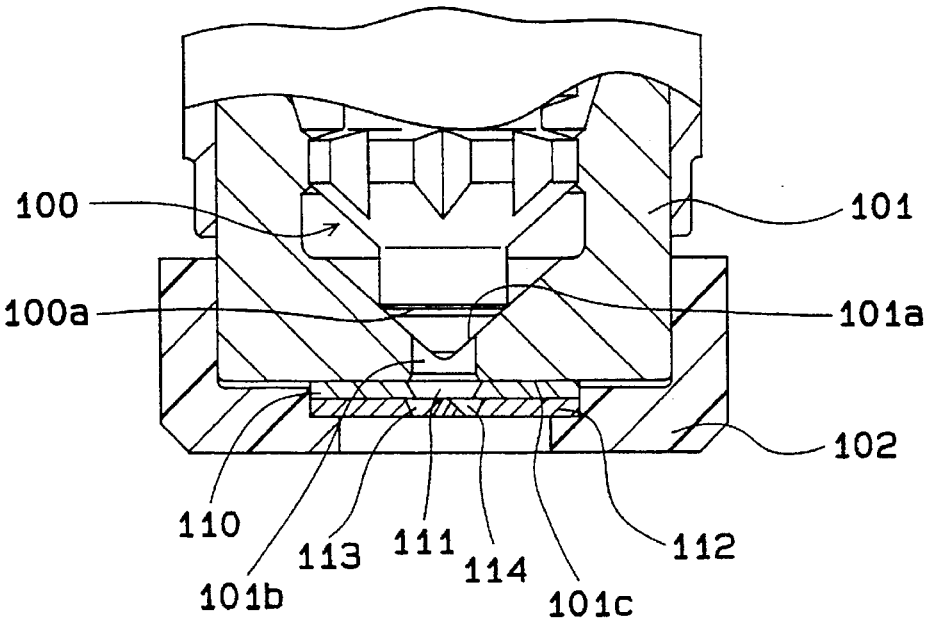
FIG. 12 shows a cross-sectional view showing the vicinity of the injection hole of the fuel injection device to which the conventional fluid injection valve is applied.
Figure 13:
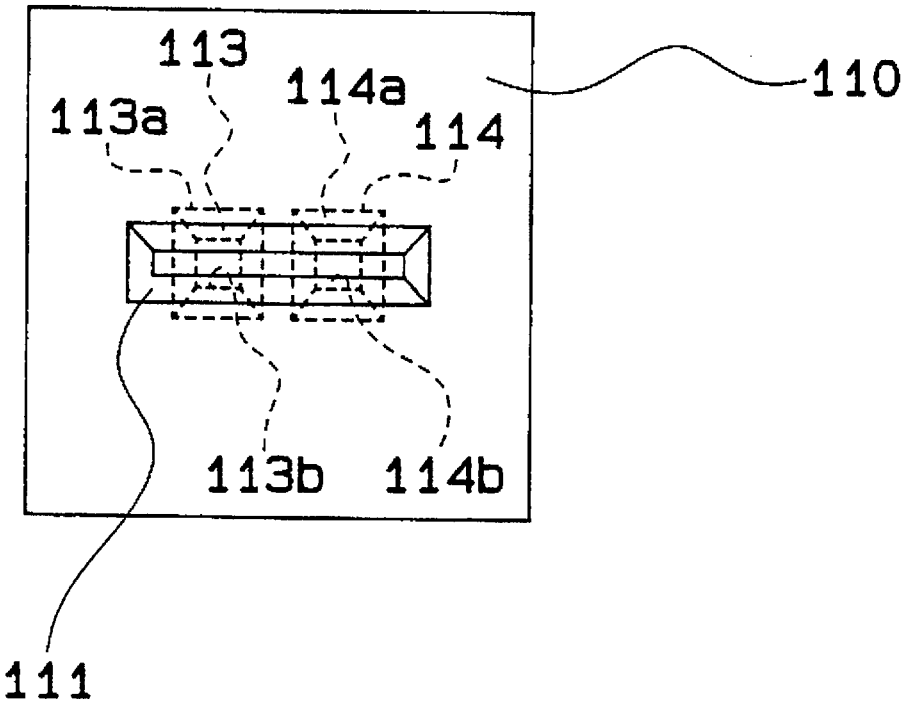
FIG. 13 shows a planar view showing the overlapping condition between the first and second orifice plates formed according to the conventional technique.

The second orifices 81 and 82 are formed on a position where the vertexes of the apex angles of the apertures 81*a* and 82*a* face each other and a virtual line connecting these two vertexes divides the bases thereof into equal halves. The inner walls 811 and 812 and the ones 821 and 822 open in opposing directions. The first orifice 71 is formed so that the length l1 of a longitudinal direction is longer than a distance l3 between the centers of the apertures 81*b* and 82*b*. Then, as shown in FIG. 10, in order to overlay the aperture 71*a* at the fuel downstream side of the first orifice 71 on a part from the vertex of isosceles triangle to the base, the first and second orifice plates are overlappingly placed.

In FIG. 7, when the needle 25 lifts from the valve seat 26*b* of the needle body 26, fuel is injected through the injection hole 26*c*. Then, the fuel injected through the injection hole 26*c* is injected and supplied from the first orifice 71 to the second ones 81 and 82. The fuel injected and supplied to the second orifices 81 and 82 flows along the inner walls 811, 812 and 813 and along the ones 821, 822 and 823 and is injected from the through-hole 35*b* to the combustion chamber (not shown in the drawings). As this time, as shown in FIG. 10, since the first orifice 71 overlaps on the inner walls 811, 812, 821 and 822 more than on the ones 813 and 823, the fuel goes to the inner walls 811, 812, 821 and 822 more than to the ones 813 and 823. Further, since the inner walls 811 and 812 and the ones 821 and 822 open in opposing directions, when the fuel flowing along the inner walls 811 and 812 and along the ones 821 and 822 meets the one flowing along the inner walls 813 and 823, the fuel is injected in two opposing directions at an angle γ2 as shown by the chain line in FIG. 11. This fuel injection angle γ2 can be adjusted by changing the opening angles of the inner walls 811 and 812 or the ones 821 and 822 or the angle Θ.

According to the second embodiment, since the dual-direction of fuel injection is specified by the respective opening angles of the inner walls 811 and 812 and the one 821 and 822, the direction of fuel injection is maintained constant even when the overlapping positions between the first and second orifice plates 70 and 80 shift slightly. Further, since this injected fuel passes through the first tapered orifice 71 and then, through the second tapered orifices 81 and 82, it is atomized to about the same level as in the first embodiment and formed into sprays having narrow-angled and suitable spraying characteristics in two directions. Therefore, the fuel supplied from the intake port (not shown in the drawings) to the combustion chamber of the internal combustion engine is formed into easily burnt sprays.

In the second embodiment, the first orifice is formed in a tapered shape. However, the present invention allows straight and sectorial formation thereof.

Further, in the second embodiment, the apertures 81*a* and 81*b* and the ones 82*a* and 82*b* are formed concentrically. It is possible, however, to better maintain the desired direction of injection even when the overlapping positions between the first and second orifice plates 70 and 80 shift by making the apertures 81*b* and 82*b* eccentric and thus move in opposing directions.

At the embodiment according to the present invention described above, the shape, size, angle, etc., of the orifice can be easily changed because the plate is formed of metal and therefore, the orifice capable of providing desired spraying characteristics can be obtained. However, the present invention allows use of materials other than metal for forming a plate as long as an orifice capable of providing desired spraying characteristics is obtained.

What is claimed is:

1. A fluid injection nozzle for injecting fluid comprising:

a needle body having an injection port at one end;

a needle for opening and closing said injection port; and a plurality of orifice plates disposed at a downstream side of said injection port, said plurality of orifice plates including a first plate having a first slit hole through which a fluid passes and a second plate overlaid on a downstream side of said first plate and provided with a plurality of second holes which communicate with a part of said first hole, each of said second holes having upstream and downstream side apertures, wherein said upstream side aperture and said downstream side aperture of at least one of said second holes are eccentric, and at least one of said plurality of second holes is defined by inner wall surfaces which face each other and extend along imaginary surfaces which intersect in a direction of injection of said fluid.

2. A fluid injection nozzle according to claim 1, wherein centers of said upstream side aperture and said downstream side aperture of each of said plurality of second holes are eccentric.

3. A fluid injection nozzle according to claim 1, wherein at least one of the first and second plates is made of metal.

4. A fluid injection nozzle according to claim 1, wherein a distance between centers of said upstream side apertures of adjacent ones of said plurality of second holes is less than a distance between centers of said downstream side apertures of said adjacent ones of said second holes.

5. A fluid injection nozzle for injecting fluid, said nozzle comprising:

a needle body having an injection port at one end;

a needle for opening and closing said injection port; and a plurality of orifice plates disposed at a downstream side of said injection port, said plurality of orifice plates including a first plate having a first slit hole through which a fluid passes and a second plate overlaid on a downstream side of said first plate and provided with a plurality of second holes which communicate with a part of said first hole, each of said second holes having upstream and downstream side apertures, wherein said upstream side aperture and said downstream side aperture of at least one of said second holes are eccentric;

wherein said upstream and downstream side apertures are formed in a polygonal shape and said second holes are defined by a plurality of planar inner walls extending from said upstream side aperture to said downstream side aperture.

6. A fluid injection nozzle according to claim 5, wherein an inclination of said planar inner wall adjacent to a center of said second plate is less steep than an inclination of planar inner wall of opposite side.

7. A fluid injection nozzle for injecting fluid, said nozzle comprising:

a needle body having an injection port at one end;

a needle for opening and closing said injection port; and a plurality of orifice plates disposed at a downstream side of said injection port, said plurality of orifice plates including a first plate having a first slit hole through which a fluid passes and a second plate overlaid on a downstream side of said first plate and provided with a plurality of second holes which communicate with a part of said first hole, each of said second holes having upstream and downstream side apertures, wherein said upstream side aperture and said downstream side aperture of at least one of said second holes are eccentric;

wherein each of said plurality of second holes is defined by a surface having a first inclination relative to said upstream and downstream side apertures at a first side of said hole proximate a center of said second plate, and a second inclination relative to said apertures greater than said first inclination at a side of said hole opposite said first side.

8. A fluid injection nozzle for injecting fluid comprising:

a needle body having an injection port at one end;

a needle for opening and closing said injection port; and a plurality of orifice plates disposed at a downstream side of said injection port, said plurality of orifice plates including a first plate having a first slit hole through which a fluid passes and a second plate overlaid on the downstream side of said first plate and provided with a plurality of second polygonal holes which communicate with a part of said first hole and whose cross-sectional areas are gradually reduced toward the downstream side, wherein a pair of adjacent ones of a plurality of inner walls defining said second polygonal holes spread in a predetermined direction of fluid injection, and an imaginary line connecting a center of an upstream side aperture of at least one of said second holes and a center of a downstream side aperture of said at least one of said second holes is inclined with respect to a thickness of said second plate.

9. A fluid injection nozzle according to claim 8, wherein a distance between centers of said upstream side apertures of adjacent ones of said plurality of second holes is less than a distance between centers of said downstream side apertures of said adjacent ones of said holes.

10. A fluid injection nozzle according to claim 9, wherein each of said plurality of second holes is defined by a surface having a first inclination relative to said upstream and downstream side apertures at a first side of said hole proximate a center of said second plate, and a second inclination relative to said apertures greater than said first inclination at a side of said hole opposite said first side.

11. A fluid injection nozzle according to claim 8, wherein at least one of the first and second plates is made of metal.

12. A fluid injection nozzle for injecting fluid comprising:

a needle body having an injection port at one end;

a needle for opening and closing said injection port; and a plurality of orifice plates disposed at a downstream side of said injection port, said plurality of orifice plates including a first plate having a first slit hole through which a fluid passes and a second plate overlaid on the downstream side of said first plate and provided with a plurality of second polygonal holes which communicate with a part of said first hole and whose cross-sectional areas are gradually reduced toward the downstream side, each of said second holes having upstream and downstream side apertures, wherein a pair of adjacent ones of a plurality of sides constituting a polygon which specifies the upstream and downstream side apertures of said second holes open in the predetermined direction of fluid injection, and an imaginary line connecting a center of said upstream side aperture of at least one of said second polygonal holes and a center of said downstream side aperture of said at least one of said second polygonal holes is inclined with respect to a thickness of said second plate.

13. A fluid injection nozzle according to claim 12, wherein said first slit hole has upstream and downstream side slit aperture, said downstream side slit aperture has a predetermined longitudinal length, said second plate has two second holes each of which having upstream and downstream side apertures, a length between centers of said two downstream side apertures of said second plate is shorter than said predetermined longitudinal length of said downstream side slit aperture.

14. A fluid injection nozzle for injecting fluid comprising:

a needle body having an injection port at one end;

a needle for opening and closing said injection port; and a plurality of orifice plates disposed at a downstream side of said injection port, said plurality of orifice plates including a first plate having a first slit hole through which a fluid passes and a second plate overlaid on a downstream side of said first plate and provided with a plurality of second holes which communicate with a part of said first hole, each of said second holes having upstream and downstream side apertures;

wherein said upstream side aperture and said downstream side aperture of at least one of said second holes are eccentric, and at least one of said upstream side aperture and said downstream side aperture of at least one of said second holes has a polygonal shape.

15. A fluid injection nozzle for injecting fluid comprising:

a needle body having an injection port at one end;

a needle for opening and closing said injection port; and a plurality of orifice plates disposed at a downstream side of said injection port, said plurality of orifice plates including a first plate having a first slit hole through which a fluid passes and a second plate overlaid on a downstream side of said first plate and provided with a plurality of second holes which communicate with a part of said first hole, each of said second holes having upstream and downstream side apertures;

wherein said upstream side aperture and said downstream side aperture of at least one of said second holes are eccentric, and at least one of said second holes is defined by a plurality of planar inner walls.

16. A fluid injection nozzle for injecting fluid comprising:

a needle body having an injection port at one end;

a needle for opening and closing said injection port; and a plurality of orifice plates disposed at a downstream side of said injection port, said plurality of orifice plates including a first plate having a first slit hole through which a fluid passes and a second plate overlaid on a downstream side of said first plate and provided with a plurality of second holes which communicate with a part of said first hole, each of said second holes having upstream and downstream side apertures, wherein at least one of said second holes being defined by a plurality of planar inner walls, an angle of inclination of one of said plurality of planar inner walls with respect to a thickness of said second plate being different from an angle of inclination of another of said plurality of planar inner walls with respect to said thickness.

* * * * *